US005110125A

United States Patent [19]

Blanc

[11] Patent Number: 5,110,125

[45] Date of Patent: May 5, 1992

[54] SPORT RACKET

[75] Inventor: Annie Blanc, Villeurbanne, France

[73] Assignee: Skis Rossignol S. A., Voiron, France

[21] Appl. No.: 658,440

[22] Filed: Feb. 20, 1991

Related U.S. Application Data

[63] Continuation of Ser. No. 341,875, Apr. 24, 1989, abandoned.

[30] Foreign Application Priority Data

Apr. 26, 1988 [FR] France ..... 88 06066

[51] Int. Cl.[5] ..... A63B 49/02

[52] U.S. Cl. ..... 273/73 C; 273/73 G

[58] Field of Search ..... 273/73 R, 73 C, 73 D, 273/73 F, 73 G

[56] References Cited

U.S. PATENT DOCUMENTS

| | | | |
|---|---|---|---|
| 4,177,990 | 12/1979 | Kajiwara | 273/73 C |
| 4,291,574 | 9/1981 | Frolow | 273/73 C |
| 4,561,655 | 12/1985 | Mortvedt | 273/73 CX |
| 4,662,634 | 5/1987 | Winkler | 273/73 G |
| 4,768,786 | 9/1988 | Kuebler | 273/73 C |
| 4,911,444 | 3/1990 | Yoneyama | 273/73 C |
| 4,919,438 | 4/1990 | Yoneyama | 273/73 C |

FOREIGN PATENT DOCUMENTS

| | | | |
|---|---|---|---|
| 616849 | 4/1980 | Switzerland | 273/73 G |
| 2205 | 10/1911 | United Kingdom | 273/73 G |

*Primary Examiner*—Edward M. Coven
*Assistant Examiner*—Sebastiano Passaniti
*Attorney, Agent, or Firm*—Browdy and Neimark

[57] ABSTRACT

A sport racket is provided wherein the thickness (e) of the cross section of the racket frame at the head and shafts is smaller than the thickness of the frame at the handle. This cross section has a constant perimeter, and has a maximum thickness (e) at the median side areas of the head of the racket.

7 Claims, 2 Drawing Sheets

FIG. 1
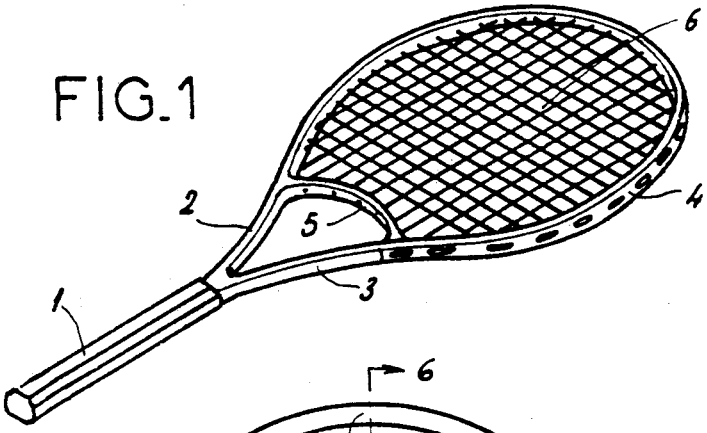
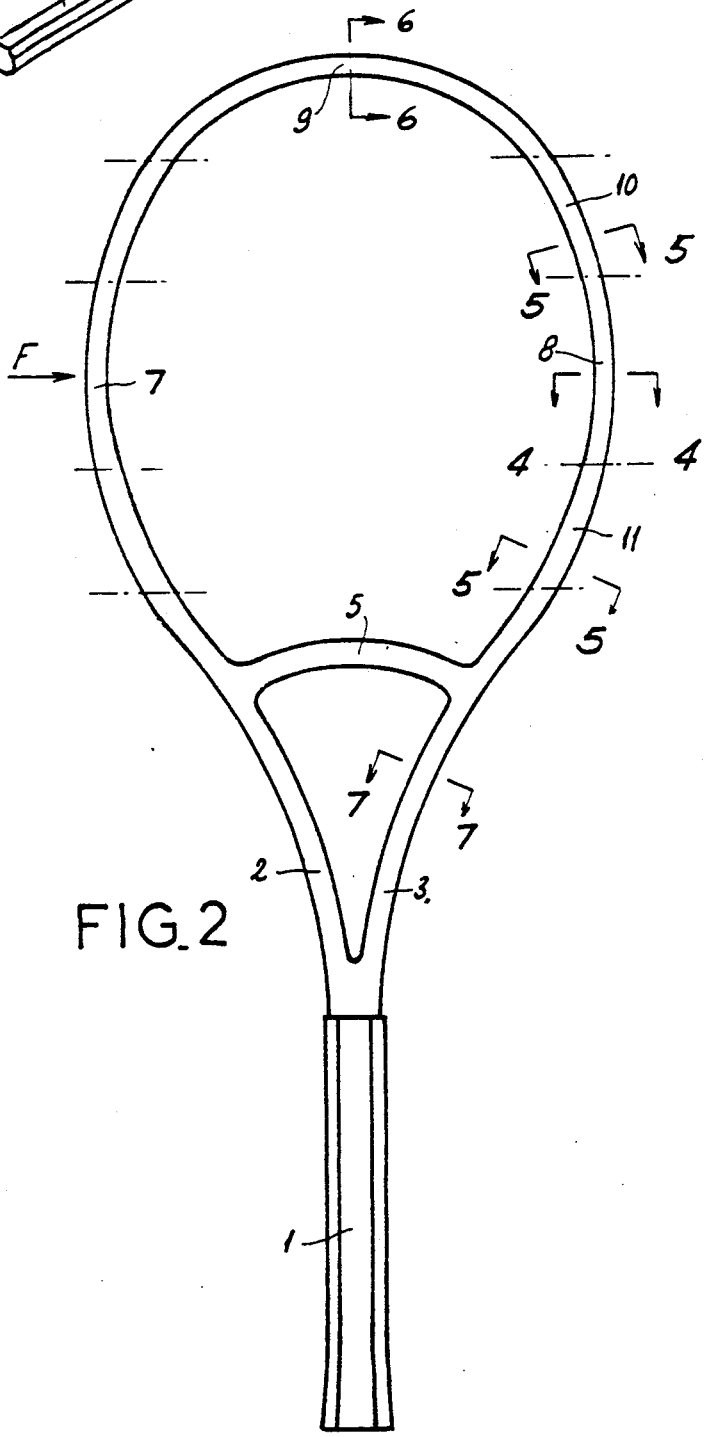
FIG. 2
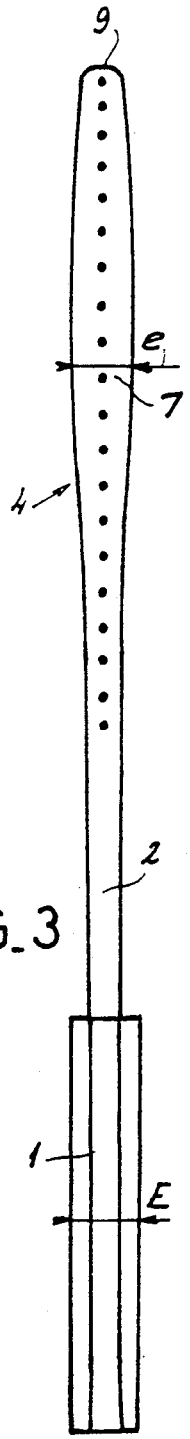
FIG. 3

SPORT RACKET

This application is a continuation of application Ser. No. 07/341,875, filed Apr. 24, 1989 now abandoned.

FIELD OF THE INVENTION

This invention pertains to a ball sport racket, more specifically designed for the game of tennis, and pertains more precisely to a racket of this type made of composite material, having as a base a fibrous reinforcement and a matrix composed of an organic material (epoxy resin, for example).

BACKGROUND OF THE INVENTION

A racket's desirable playing qualities are determined by relatively numerous factors that can generally be divided into two categories:

Performance factors: results, tension, stiffness, etc.;

Player comfort factors: smoothness, ease in control, etc.;

However, certain factors such as tolerance for off-center ball impacts, can be included in both categories.

These two categories of factors are most often mutually-exclusive, i.e., comfort generally cannot be improved without sacrificing performance, and vice versa.

We know that a system that is exposed to a perturbation vibrates around one or more natural frequencies that are characteristic of its structure and that result from its mass distribution and stiffness. The resulting behavior of this complexity of vibrations is the sum of the movements that are generated in various directions by the resonance frequency of this structure. Said movements are at their minimum values in areas currently known as vibration "nodes," and are at their maximum values in areas currently known as vibration "antinodes."

We have been able to demonstrate that, in the case of a tennis player, the vibrations transmitted to the latter through his racket after a ball impact are correlated directly to his perception of the behavior of his instrument. In the 0 to 1,000 Hz frequency range, in which humans are highly receptive to vibrations, tennis rackets vibrate in several directions and frequencies, which correspond to what will be referred to below as "natural modes of vibration." In this way, it was possible to identify seven natural modes of vibration, closely correlated to the behavior of the racket in play:

Three are located in a direction perpendicular to the plane of the racket; these are the modes of simple flexion perpendicular to the longitudinal median plane of the racket;

Two are located in the plane of the racket; these are the modes of lateral flexion;

Two more are connections between the flectional vibrations perpendicular to the longitudinal median plane of the racket, and torsional vibrations around its longitudinal median axis.

These vibrations generate considerable stress within the frame of the racket, which stress can cause breakage. For rackets made of composite materials, this risk of breakage can be avoided on an a priori basis either by adding very expensive special reinforcement fibers to the frame formula, or by making the cross sections of the frame larger according to the directions and areas most likely to be exposed to the stress.

It is also a known practice to make rackets having cross sections that vary throughout the length of the frame in order to improve their desirable playing qualities. For example, EP-A-0 176 021 pertains to a tennis racket having a frame with variable cross section, and which is designed to optimize the ball return effect by tuning the oscillation frequency of the frame to the pulsation rate of the ball. The thickness of this racket (taken in the direction orthogonal to the plane of the racket) is variable, being at its maximum value at the shafts, the thickness of the shafts also being greater than that of the handle.

Such an oversized thickness of the frame probably prevents the frame from breaking. However, the resulting rackets are very rigid, so that, although advanced players may appreciate them, the rackets are less appropriate for beginners because of their low degree of tolerance for off-center ball impact points. It also must be noted that the appearance of the resulting racket may be unappealing to some users, who would be more inclined to purchase a racket with a thinner, and thus more elegant look.

SUMMARY OF THE INVENTION

The present invention pertains to a sports racket, and more specifically to a racket made of composite material, the frame of which has a variable cross section, and which, while maintaining a thin and elegant outside appearance, is shaped in order to minimize the risks of breaking the frame, while optimizing the desirable playing qualities, and remaining within the range accessible to the general public, i.e., not restricted especially to elite players.

As mentioned above, the cross section of the frame of this racket varies along the shafts and the head. On the other hand, the cross section maintains a constant perimeter all along the shafts and the head. Moreover, the cross section is thinner than that of the handle, reaching its maximum thickness in the respective median areas of the side parts of the head In the latter area, the width of the cross section is at its minimum value (it should be recalled that we define "thickness" as the height of the frame in the direction orthogonal to the plane of the racket, and "width" as that of the cross section of the frame taken in the plane of the racket). Finally, the frame has no outside groove for the passage of the strings and thus the outside surface of its cross section is strictly convex over its entire length.

BRIEF DESCRIPTION OF THE DRAWINGS

The invention shall be clearly understood and its advantages and additional characteristics disclosed in the following description of a non-restrictive example of an embodiment, with reference to the attached schematic drawing, wherein:

FIG. 1 is a perspective view of the racket;

FIG. 2 is a flat view of the racket, not including the strings;

FIG. 3 is a side view according to F in FIG. 2;

DETAILED DESCRIPTION OF THE INVENTION

Figure 4:
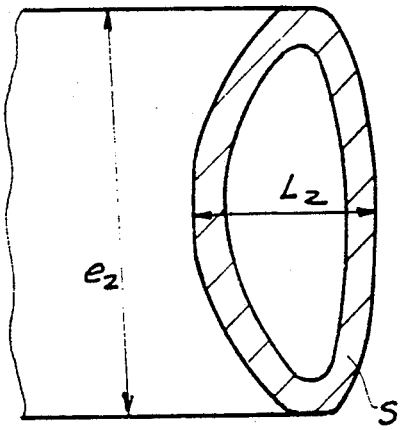
FIGS. 4, 5, 6 and 7, are cross sections of the frame seen respectively along 4—4, 5—5, 6—6, and 7—7 in FIG. 2.

With reference to FIG. 1, the tennis racket is composed of a handle or grip 1 which is extended by two shafts 2, 3 that hold head 4, the lower part of which forms bridge 5. The head 4 itself holds strings 6, composed of main strings and cross strings, which form the striking surface.

With reference now to FIGS. 2 to 7, thickness e of the frame of the racket, more specifically that of shafts 2, 3 of head 4, is smaller than thickness E of handle 1. Moreover, cross section S (see FIGS. 4–7) of the frame varies along shafts 2, 3 and head 4, with the perimeter of the cross section S still remaining constant along the shafts and the head. Thickness e of the cross section S is at its maximum in the median area (respectively 7 and 8) of the two side parts of head 4. The cross section S in this area can be seen in FIG. 4. In the same median area 7, 8, width L of variable cross section S is at its minimum value, while ratio e/L is at its maximum value and is equal to 2.2 in this example, so that cross section S has a substantially elongated aspect in the direction of thickness e.

Figure 7:
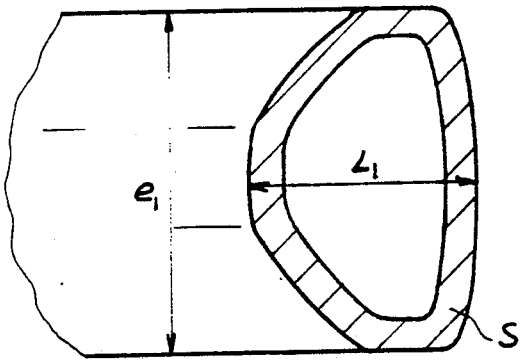

On the contrary, at shafts 2, 3, thickness e of cross section S is at its minimum value, while its width L is at its maximum value, as shown in FIG. 7: in these areas, cross section S has a substantially solid aspect, with ratio e/L being at its minimum value, equal to 1.53 in this example.

Figure 6:
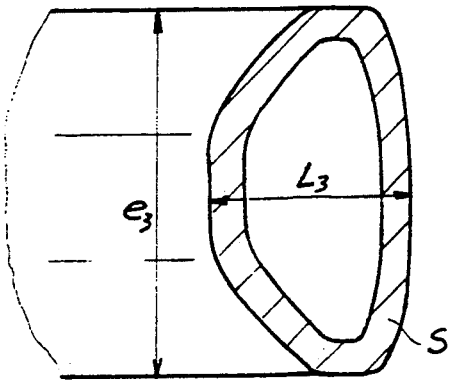

The cross section of the frame at crown 9 of the head is shown in FIG. 6. In this area, the aforementioned e/L value substantially constitutes the average of the value at the median side areas (FIG. 4) and at the shafts (FIG. 7): in this specific example, the ratio e/L at the crown of the frame is equal to 1.82.

Figure 5:
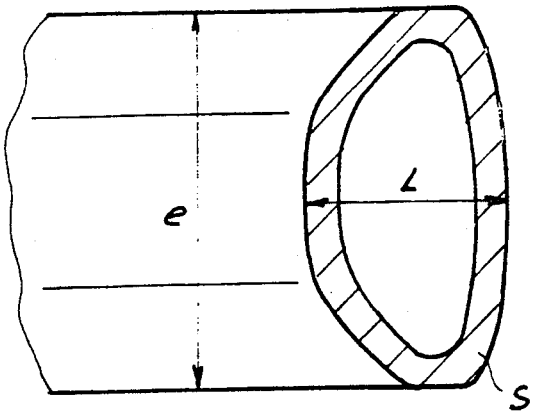

Of course, the variations in cross section are progressive all along the frame. For example, FIG. 5 shows the cross section of the frame in areas 10 and 11, which make the transition between median side areas 7, 8 and crown area 9 on the one hand, and between the areas 7, 8 and shafts 2, 3 on the other hand.

Figure 8:
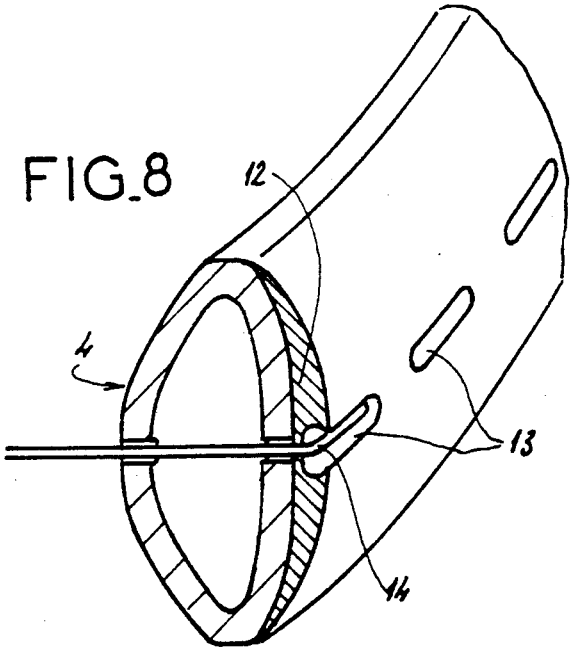
FIG. 8 is a detailed view with a cross section of a portion of the head of the racket, at the level of a cross string.

Finally, in order to produce an effective arrangement of the strings of the frame, it was found advantageous not to provide the frame with an outside groove for the passage of the strings. The outside groove is replaced with a band 12 mounted around head 4, containing elongated sockets 13 to accommodate strings 14, as shown in FIG. 8.

Obviously, the invention is not limited to the example embodiment described above, and, on the contrary, can be executed in multiple equivalent forms. Of course, it applies to rackets for ball sports in the same family as tennis rackets, such as squash or badminton rackets. Generally speaking, the aforementioned ratio e/L is between 2 and 2.5 at the median side areas 7, 8, it is between 1.3 and 1.6 at shafts 2, 3, and is between 1.6 and 2 at crown 9.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A sport racket made of composite material having as a base a fibrous reinforcement and a matrix composed of organic material, said racket comprising:

a frame having two shafts connected to a head which holds strings to form a striking surface;

wherein the cross-section of the frame varies along the shafts and head such that said cross-section has a maximum width ($L_1$) and a minimum thickness ($e_1$) along said shafts, a minimum width ($L_2$) and a maximum thickness ($e_2$) along median portions, and a width ($L_3$) and a thickness ($e_3$) at a crown portion of said head which are intermediate the cross-sections of said shafts and said median portions, the thickness ($e_1$) of said shafts being smaller than the thickness of a handle of the racket; and wherein the cross-section maintains a constant perimeter along the shafts and the head.

2. A racket according to claim 1 wherein the frame has no outside groove for the passage of strings.

3. A racket according to claim 1 wherein the thickness ($e_1$) of the frame is at its minimum in the areas of the shafts.

4. A racket according to claim 3 wherein at the crown of the frame, the ratio $e_3/L_3$ between the thickness and the width of the cross section is substantially equal to the average of the ration taken at the median side areas of the head and at the shafts.

5. A racket according to claim 4 wherein the ratio $e_2/L_2$ is between 2 and 2.5 at the median side areas, the ratio $E_1/L_1$ is between 1.3 and 1.6 at the shafts, and the ratio $e_3/L_3$ is between 1.6 and 2 at the crown.

6. A sport racket made of a composite material including a fibrous reinforcement and a resinous matrix, said racket comprising:

an elongated handle portion having a pair of shafts divergently extending from an end thereof and a head extending from said shafts which holds strings to form a striking surface, said shafts and head comprising a frame;

said head defining a first transition portion (11) closest to said shafts, a median portion (7, 8) adjacent said first transition portion, a second transition portion (10) adjacent said median portion (8) and a crown portion (9) farthest from said shafts, said frame having a varying cross-section from said shafts to said crown whereby the cross-section at said shafts has a maximum width ($L_1$) and a minimum thickness ($e_1$), the cross-section at said median portion has a minimum width ($L_2$) and a maximum thickness ($e_2$), the cross-section at said crown has a width ($L_3$)and a thickness ($e_3$) which are intermediate the cross-sections of said shaft and said median portion, and the cross-section of said transition portions varies gradually between said shafts and said median portion and between said median portion and said crown;

each of said thicknesses of said frame being smaller than the thickness of said handle.

7. A racket according to claim 6 wherein the ratio $e_2/L_2$ is between 2 and 2.5 at the median portions the ratio $e_1/L_1$ is between 1.3 and 1.6 at the shafts, and the $e_3/L_3$ is between 1.6 and 2 at the crown.

* * * * *